US005292403A

United States Patent [19]

Dreisbach et al.

[11] Patent Number: 5,292,403

[45] Date of Patent: Mar. 8, 1994

[54] METHOD FOR INHIBITING THE DEPOSITION OF ORGANIC CONTAMINANTS IN PULP AND PAPERMAKING PROCESSES

[75] Inventors: David D. Dreisbach; Mark E. Laurint, both of Jacksonville, Fla.

[73] Assignee: Betz PaperChem, Inc., Jacksonville, Fla.

[21] Appl. No.: 29,209

[22] Filed: Mar. 10, 1993

[51] Int. Cl.[5] ..... D21H 17/72

[52] U.S. Cl. ..... 162/158; 162/168.1; 162/175; 162/176; 162/177; 162/178; 162/183; 162/199; 162/DIG. 4

[58] Field of Search ..... 162/158, 180, 168.1, 162/175, 176, 177, 178, 183, 199, DIG. 4

[56] References Cited

U.S. PATENT DOCUMENTS

| | | | |
|---|---|---|---|
| 4,071,375 | 1/1978 | Ishibe et al. | 162/180 |
| 4,842,691 | 6/1989 | Nakajima et al. | 162/180 |
| 4,983,257 | 1/1991 | Schultz et al. | 162/180 |
| 5,082,697 | 1/1992 | Patton et al. | 162/158 |

FOREIGN PATENT DOCUMENTS 0493066 12/1991 European Pat. Off. .

*Primary Examiner*—Peter Chin

*Attorney, Agent, or Firm*—Alexander D. Ricci; Gregory M. Hill

[57] ABSTRACT

A method of inhibiting the deposition of organic contaminants in a pulp and papermaking system comprising adding to the system an effective amount of a detackifying composition comprising a charged polymer and an oppositely charged surfactant, with the proviso that at least the polymer or the surfactant be surface active.

8 Claims, 14 Drawing Sheets

METHOD FOR INHIBITING THE DEPOSITION OF ORGANIC CONTAMINANTS IN PULP AND PAPERMAKING PROCESSES

FIELD OF THE INVENTION

The present invention relates to methods for inhibiting the deposition of organic contaminants from pulp in pulp and papermaking systems.

BACKGROUND OF THE INVENTION

The deposition of organic contaminants in the pulp and paper industry can cause both quality and efficiency problems in pulp and papermaking systems. Some components occur naturally in wood and are released during various-pulping and papermaking processes. The term "pitch" can be used to refer to deposits composed of organic constituents which may originate from these natural resins, their salts, as well as coating binders, sizing agents, and defoaming chemicals which may be found in the pulp. In addition, pitch frequently contains inorganic components such as calcium carbonate, talc, clays, titanium, and related materials.

Stickies is a term that has become increasingly used to describe deposits that occur in systems using recycled fiber. These deposits often contain the same material found in "pitch" deposits in addition to adhesives, hot melts, waxes, and inks. All of the aforementioned materials have many common characteristics including: hydrophobicity, deformability, tackiness, low surface energy, and the potential to cause problems with deposition, quality, and efficiency in the process. Diagram 1 shows the complex relationship between pitch and stickies discussed here.

Diagram 1

| | Pitch | Stickies |
|---|---|---|
| Natural Resins (fatty and resin acids, fatty esters, insoluble salts, sterols, etc.) | X | X |
| Defoamers (oil, EBS, silicate, silicone oils, ethoxylated compounds, etc.) | X | X |
| Sizing Agents (Rosin size, ASA, AKD, hydrolysis products insoluble salts, etc.) | X | X |
| Coating Binders (PVAC, SBR) | X | X |
| Waxes | | X |
| Inks | | X |
| Hot Melts (EVA, PVAC, etc.) | | X |
| Contact Adhesives (SBR, vinyl acrylates, polyisoprene, etc.) | | X |

The deposition of organic contaminants can be detrimental to the efficiency of a pulp or paper mill causing both reduced quality and reduced operating efficiency. Organic contaminants can deposit on process equipment in papermaking systems resulting in operational difficulties in the systems. The deposition of organic contaminants on consistency regulators and other instrument probes can render these components useless. Deposits on screens can reduce throughput and upset operation of the system. This deposition can occur not only on metal surfaces in the system, but also on plastic and synthetic surfaces such as machine wires, felts, foils, Uhle boxes and headbox components.

Historically, the subsets of the organic deposit problems, "pitch" and "stickies" have manifested themselves separately, differently and have been treated distinctly and separately. From a physical standpoint, "pitch" deposits have usually formed from microscopic particles of adhesive material (natural or man-made) in the stock which accumulate on papermaking or pulping equipment. These deposits can readily be found on stock chest walls, paper machine foils, Uhle boxes, paper machine wires, wet press felts, dryer felts, dryer tans, and calendar stacks. The difficulties related to these deposits included direct interference with the efficiency of the contaminated surface, therefore, reduced production, as well as holes, dirt, and other sheet defects that reduce the quality and usefulness of the paper for operations that follow like coating, converting, or printing.

From a physical standpoint, "stickies" have usually been particles of visible or nearly visible size in the stock which originate from the recycled fiber. These deposits tend to accumulate on many of the same surfaces that "pitch" can be found on and cause many of the same difficulties that "pitch" can cause. The most severe "stickies" related deposits however tend to be found on paper machine wires, wet felts, dryer felts, and dryer cans.

Methods of preventing the build up of deposits on the pulp and papermill equipment and surfaces are of great importance to the industry. The paper machines could be shut down for cleaning, but ceasing operation for cleaning is undesirable because of the consequential loss of productivity, poor quality while partially contaminated and "dirt" which occurs when deposits break off and become incorporated in the sheet. Preventing deposition is thus greatly preferred where it can be effectively practiced.

In the past stickies deposits and pitch deposits have typically manifested themselves in different systems. This was true because mills usually used only virgin fiber or only recycled fiber. Often very different treatment chemicals and strategies were used to control these separate problems.

Current trends are for increased mandatory use of recycled fiber in all systems. This is resulting in a co-occurance of stickies and pitch problems in a given mill. It is desirable to find treatment chemicals and strategies which will be highly effective at eliminating both of these problems without having to feed two or more separate chemicals. The materials of this invention have clearly shown their ability to achieve this goal.

Pitch control agents of commerce have historically included surfactants, which when added to the system, can stabilize the dispersion of the pitch in the furnish and white water. Stabilization can help prevent the pitch from precipitating out on wires and felts.

Mineral additives such as talc have also found use and can reduce the tacky nature of pitch by adsorbing finely dispersed pitch particles on their surfaces. This will reduce the degree to which the particles coagulate or agglomerate.

Polyphosphates have been used to try to maintain the pitch in a finely dispersed state. Alum has also been widely used to reduce deposition of pitch and related problems.

Both chemical and non-chemical approaches to stickies control are employed by papermakers. Non-chemical approaches include furnish selection, screening and cleaning, and thermal/mechanical dispersion units.

Chemical treatment techniques for stickies control include dispersion, detackification, wire passivation and cationic fixation. Chemicals used included talc, polymers, dispersants and surfactants.

GENERAL DESCRIPTION OF THE INVENTION

The above noted problems and others in the field of controlling the deposition of organic contaminants in a pulp and papermaking process are addressed by the present invention. The deposition of pitch and stickies in such systems is due to the adhesive tendency or "tackiness" of these organic contaminants. The present invention significantly reduces the adhesive tendency of these materials thereby inhibiting their deposition on the deposition prone surfaces in a papermaking system.

It has been discovered that a combination of certain chemical compounds added to a pulp and papermaking system have a significant effect on reducing the adhesive tendency of these organic contaminants. The treatment composition of the present invention comprises a polymer utilized in conjunction with an oppositely charged surfactant, with at least one compound being surface active.

DETAILED DESCRIPTION OF THE INVENTION

Figure 1:
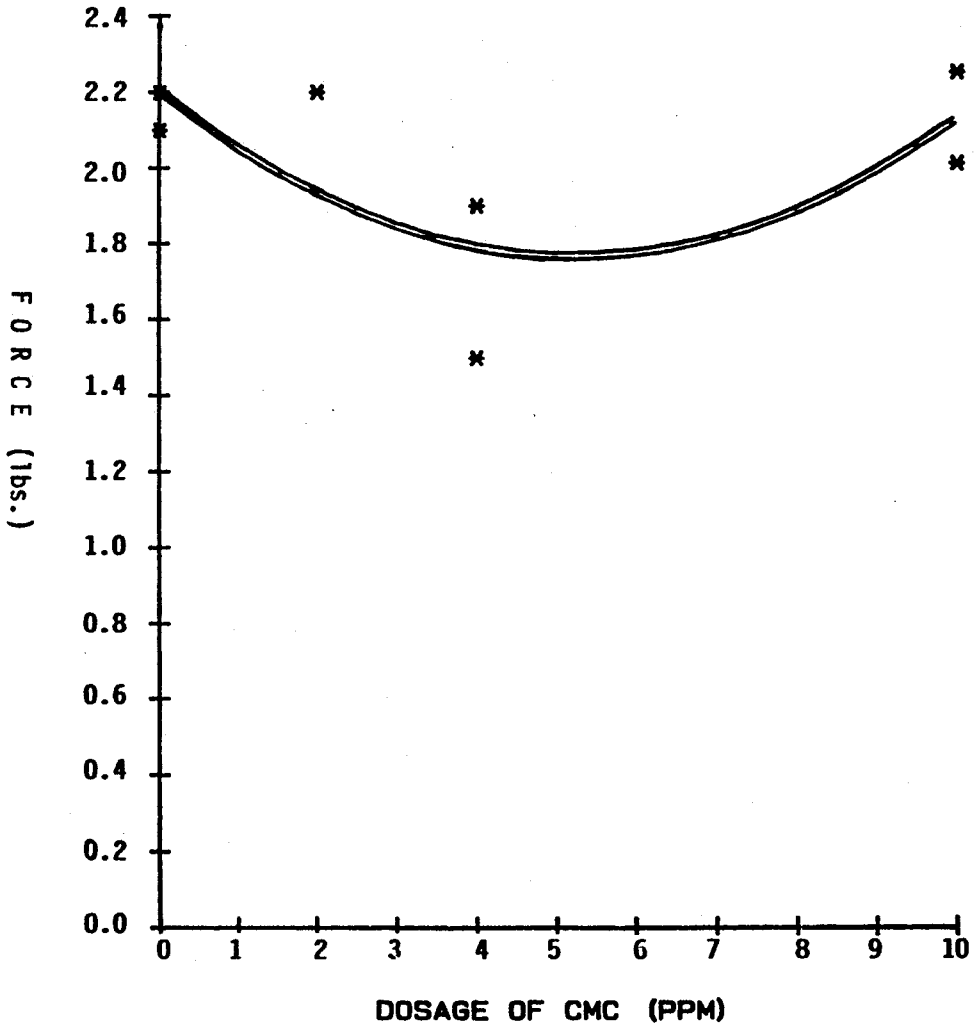
FIGS. 1-14 show the efficacy of the present invention with various chemical combinations.

The present invention comprises a process for the effective inhibition of the deposition of organic contaminants in pulp and papermaking processing systems comprising adding to these systems an effective amount of a charged polymer in combination with an oppositely charged surfactant, with the proviso that one compound be surface active in order to detackify the organic contaminants. The combinations include a cationic polymer with an anionic surfactant or anionic polymer with a cationic surfactant.

Representative cationic polymers are cationic cellulose starch compounds, which are commercially available as Celquat L-200 and Stalock 600. Characteristic anionic polymers include carboxymethyl cellulose. These compounds are commercially avail able having high molecular weight under the trade name CMC-12M8, medium molecular weights under the name CMC-7LT and low molecular weights as Ambergum 670. Other anionic polymers are carboxymethylated starch (Staley 34–450), xanthan gum (Kelzan D), guar gum (Celbond 7) and polyacrylic acid (Alcogum 296w for medium molecular weights or Carbopol 910 for high molecular weights).

Representative cationic surfactants include allyltrimethylamine (commercially available as Genamin KDF and Aerosurf E-228) and alkyl imidazoline (Alkazine 0). Any anionic surfactants may be utilized in this invention. One such example is the sodium soap of tall oil fatty acid (Sylvatol 40).

The above list is merely intended to be representative of the classes of compounds which may be utilized in accordance with this invention. What is essential is that the polymer and surfactant chosen be oppositely charged and that one of them be surface active.

In the practice of this invention, the addition of the two compounds to the papermaking system may be achieved in many ways. First the two agents could be mixed together in a single container and fed to the system directly. Second, the two agents could be transported separately to the mill, then combined in a tank or mixing stream prior addition to the system. Third, each agent could be added separately to the system. This could be achieved either simultaneously or sequentially, e.g. addition of each agent separated by a period of time as desired by the mill operators. By "addition" to the system it is contemplated that the agents may be added directly to the pulp slurry at any point in the papermaking system where organic contaminant deposition is a problem or the agents may be sprayed onto deposition prone surfaces such as wires or felts. The total dosage of said agents may range from 0.1 ppm to 100 ppm, by weight.

The treatment program of the present invention may be utilized in all papermaking processes where the deposition of organic contaminants is a problem. Such processes include those where the furnish is entirely derived from virgin wood chips or those where a fraction of secondary fiber is utilized.

The efficacy of the present-invention will now be shown by the following examples. The agents utilized are representative of the invention and are not intended to be a limitation on the scope of the invention.

EXAMPLES

A comprehensive test procedure was developed to measure the efficacy of the present invention. Pressure sensitive adhesive packing tape was used as the standardized tacky material. Pieces of this tape were soaked in water either with or without the treatment composition of the invention. After 1 hour of soak time, the tapes were removed from the water and pressed against the surfaces of plastic film coupons under a standard pressure. The tape and coupons were then pulled apart and the, average force, required to separate these surfaces was determined.

The force recorded for the sample without treatment became the benchmark against which the treated samples were measured. The force reductions for the treated samples are shown on the following tables and figures.

Cationic Surfactant with Anionic Polymer

Figure 2:
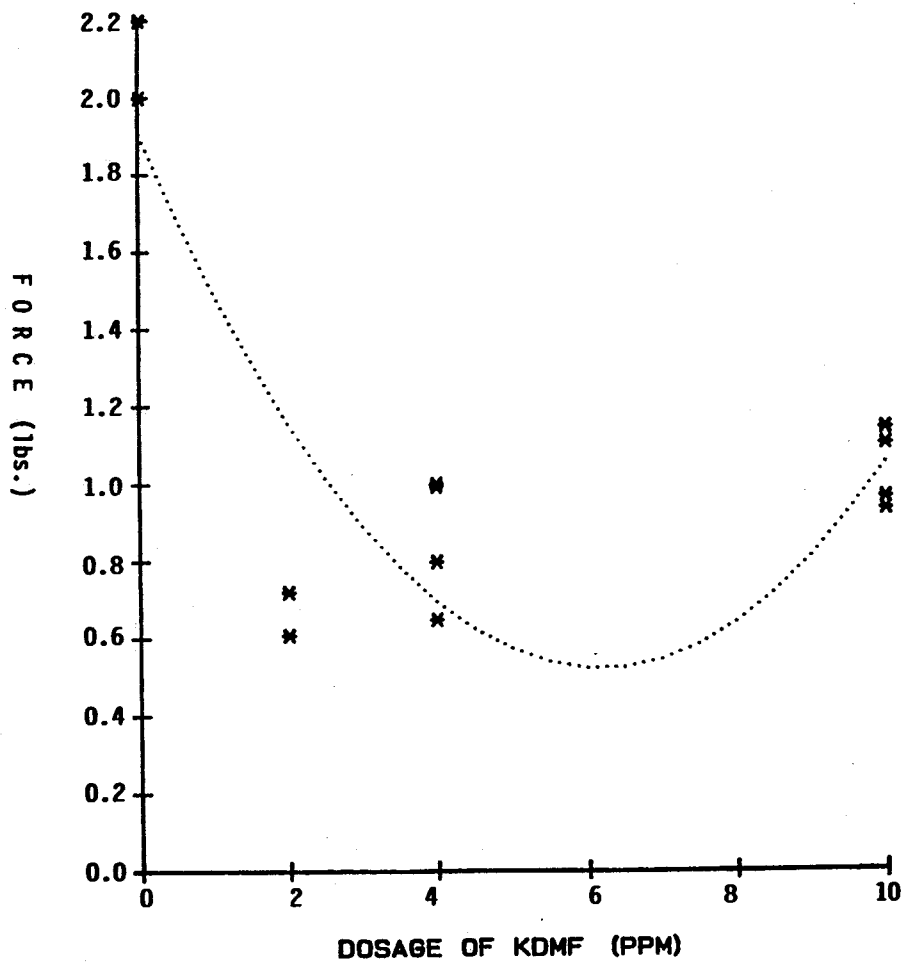
Figure 3:
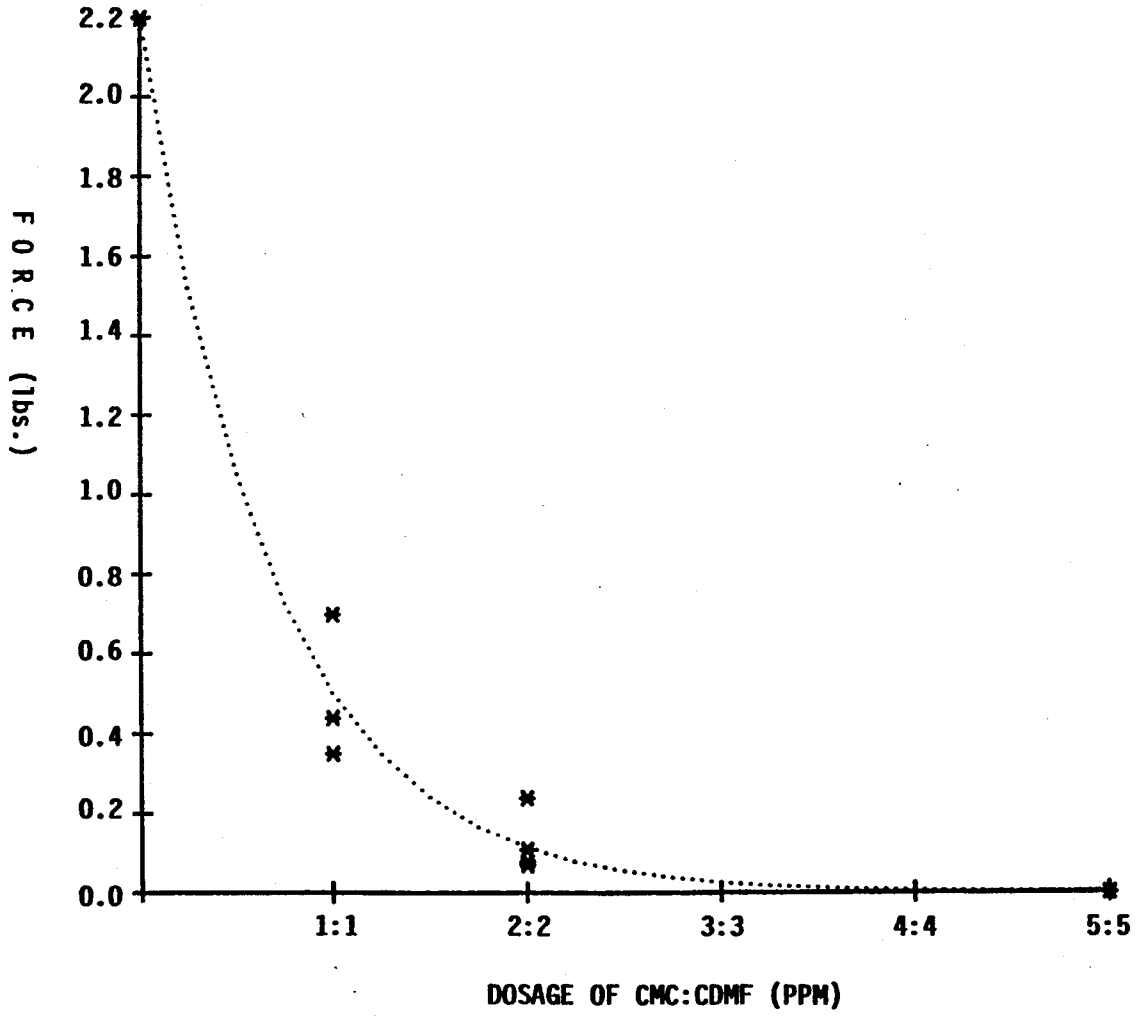

An alkyltrimethylamine cationic surfactant (Genamin KDMF) was tested in combination with several anionic polymers. The first such anionic polymer tested was carboxymethyl cellulose (CMC 12M-8). First, different dosages of KDMF and CMC 12M-8 alone were tested (FIGS. 1 and 2, respectively). The KDMF showed some. efficacy at low dosages, but, as the dosage rose its efficacy decreased. However, when KDMF and CMC12M-8 were added at equal ratios a 100% reduction in force was recorded at dosages of 5.0 ppm each (FIG. 3).

Figure 4:
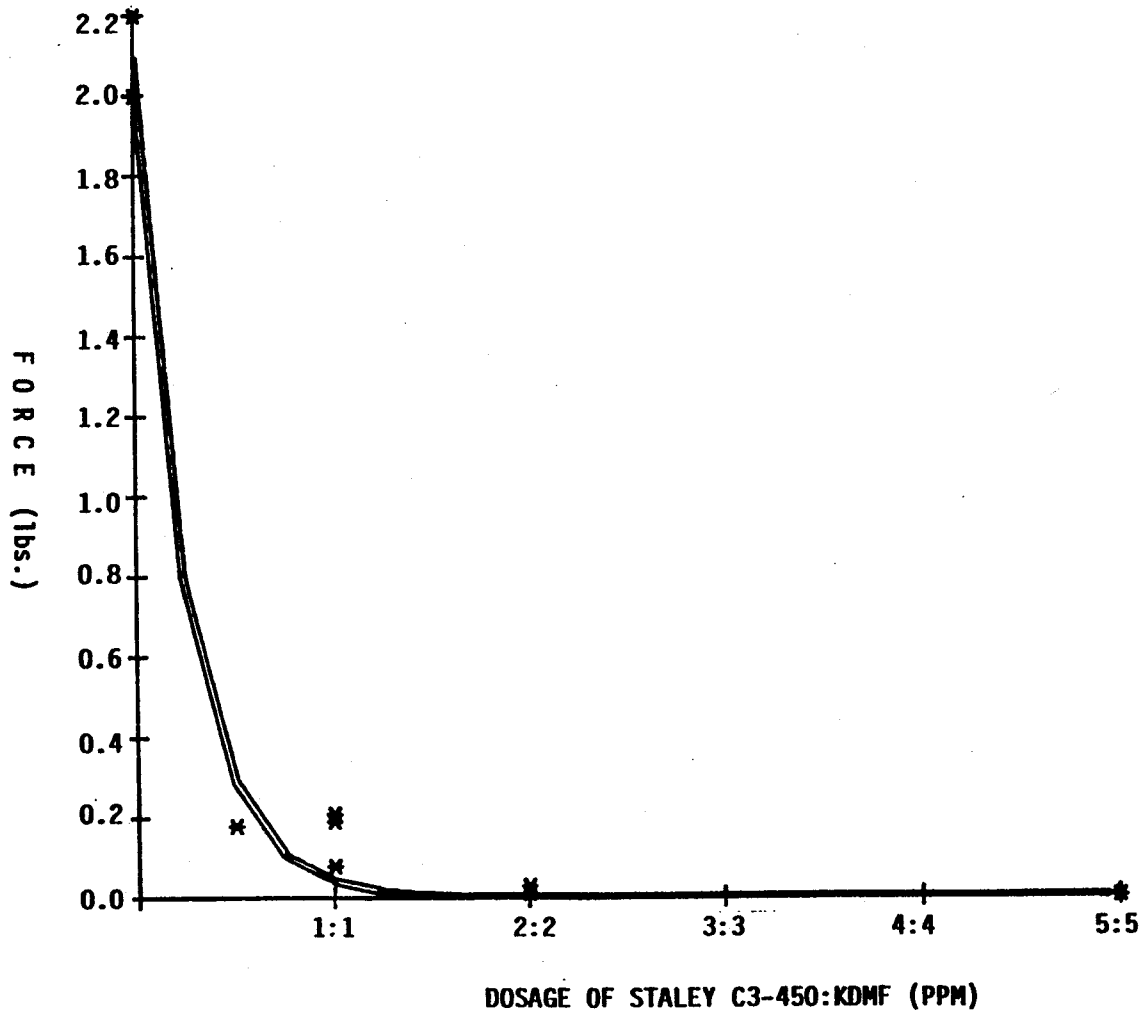
Figure 5:
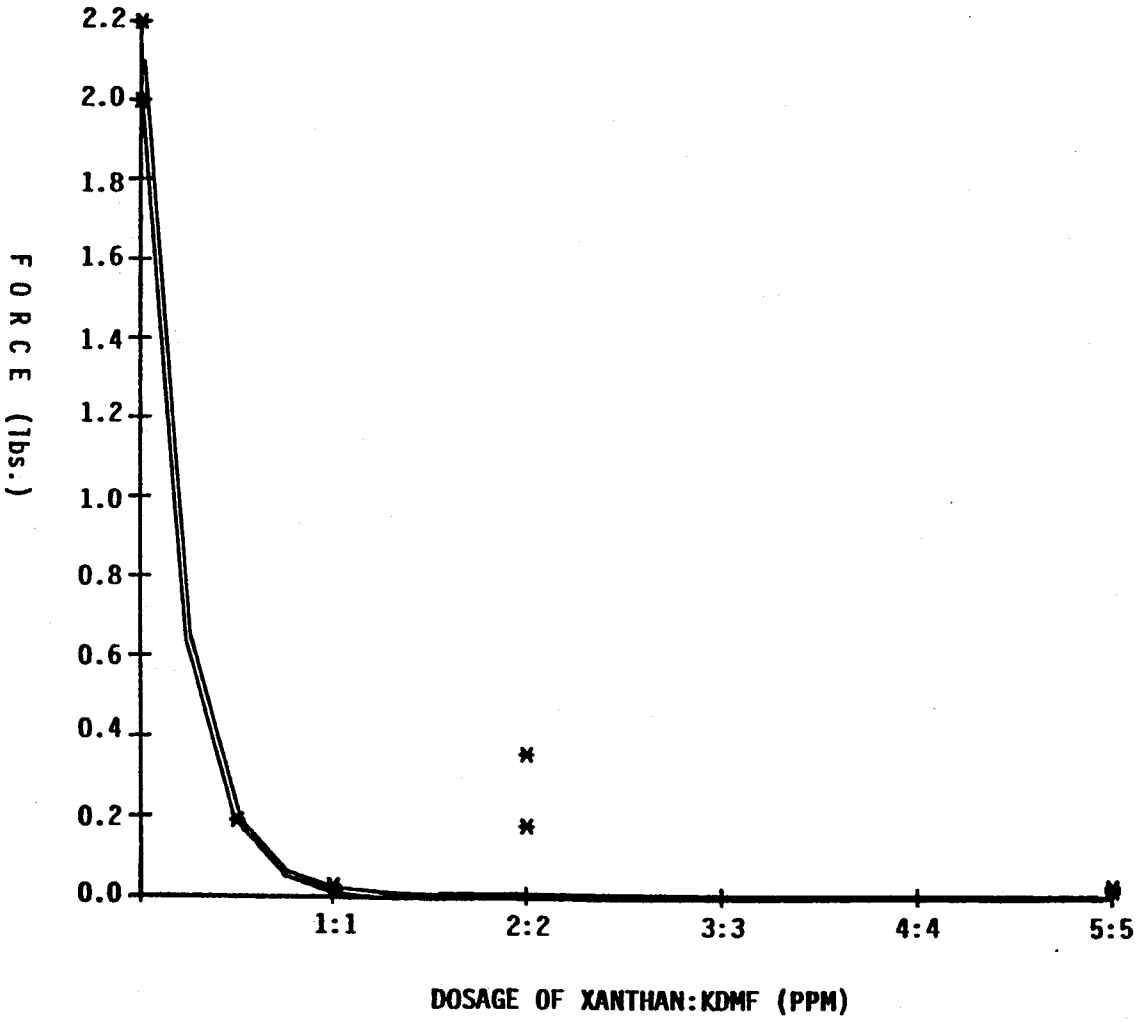
Figure 6:
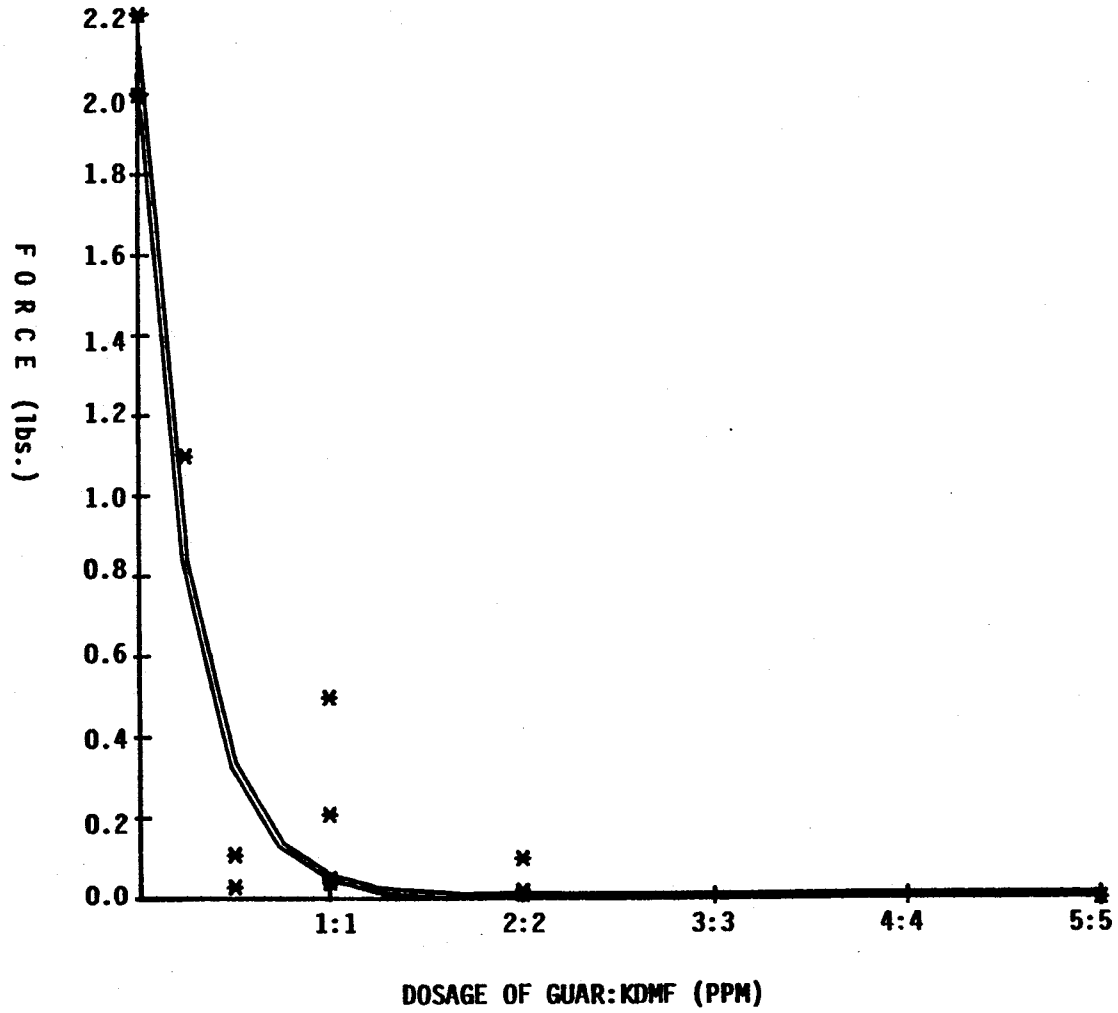
Figure 7:
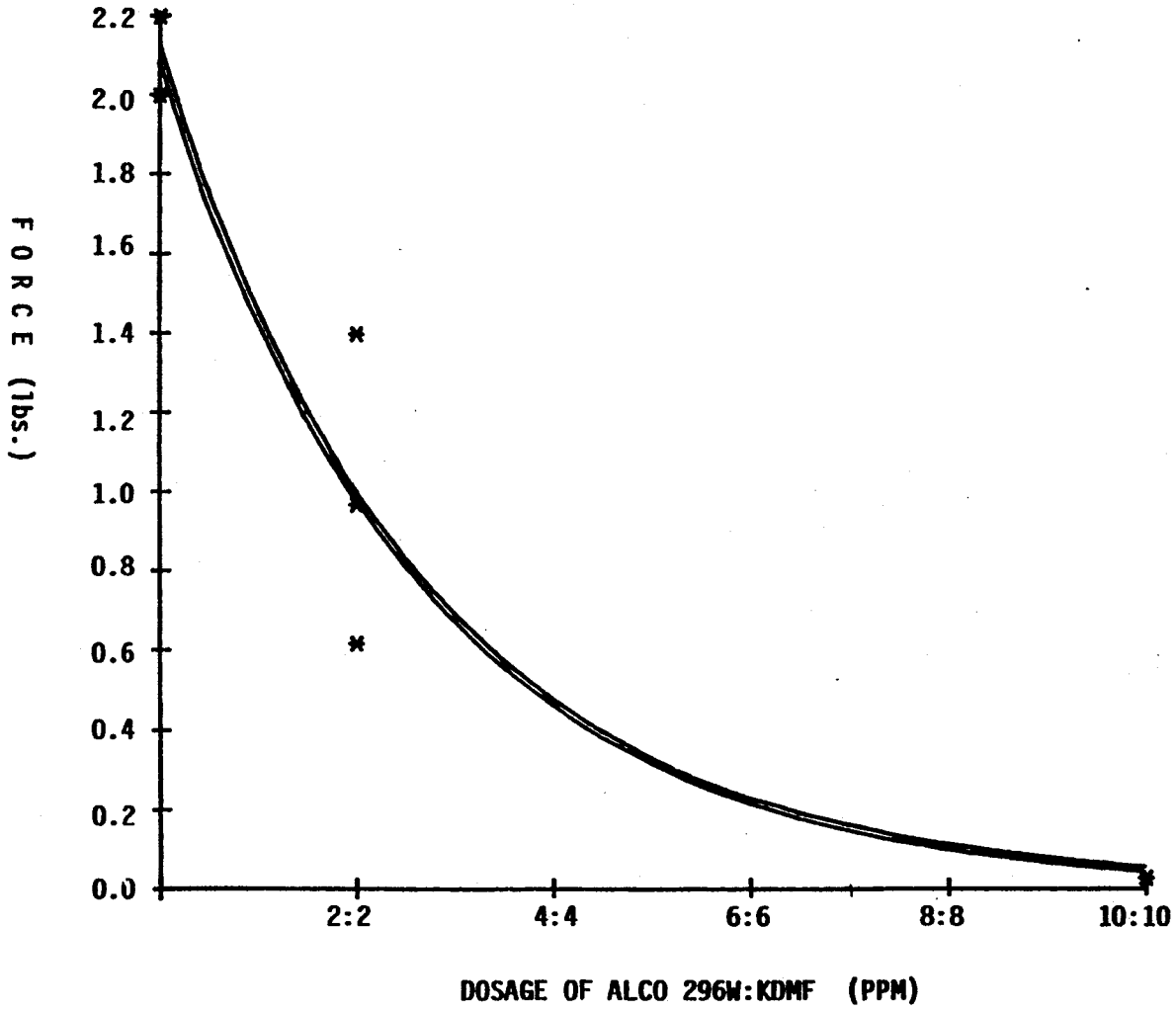
Figure 8:
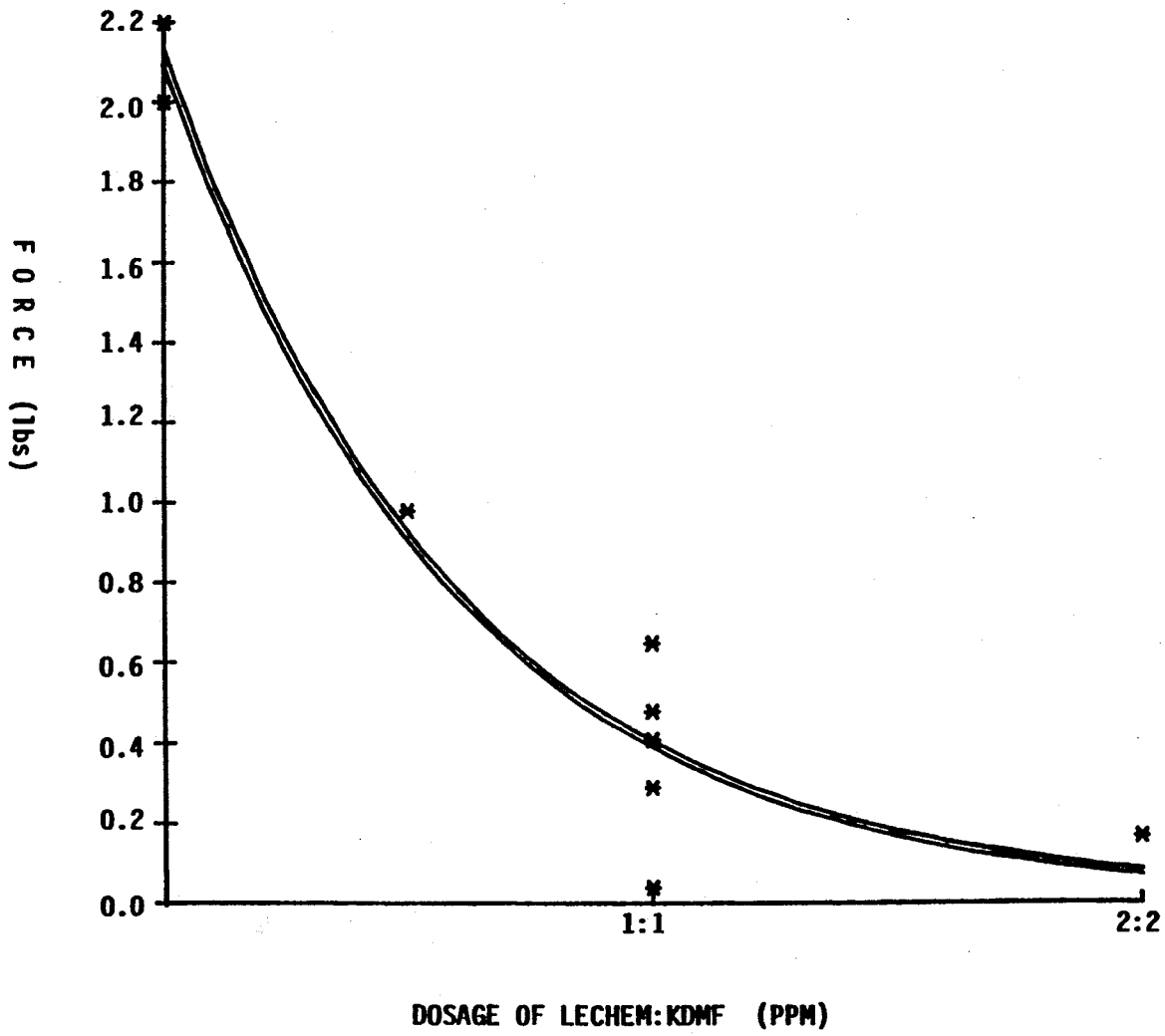
Figure 9:
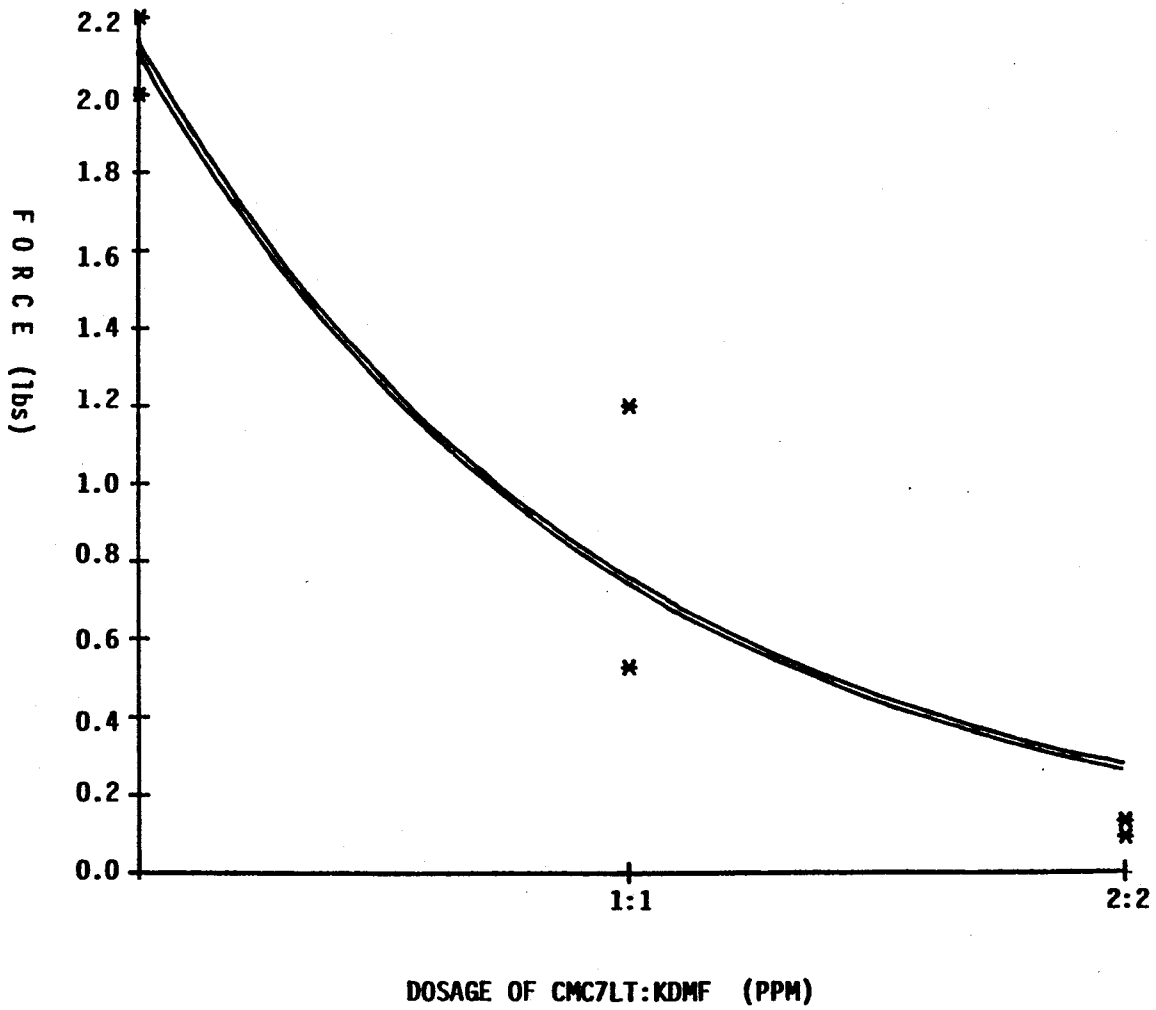

Other anionic polymers were tested with KDMF and similar results were obtained. None of these polymers exhibited significant efficacy alone but when added in combination with KDMF, significant reductions in adhesion was recorded. The results of these anionic polymers with KDMF are shown in the figures as noted: Staley C3—450 (FIG. 4), Xantham gum (FIG. 5), guar gum (FIG. 6), Alco 296W (FIG. 7), Lechem T-75-L (FIG. 8) and CMC 7LT (FIG. 9).

Cationic Polymer with Anionic Surfactant

The efficacy of a cationic Polymer with an oppositely charged anionic surfactant is demonstrated by using cationic cellulose (Celquat L-200) as the polymer in combination with a tall oil fatty acid (Sylvatol 40) as the anionic surfactant.

Figure 10:
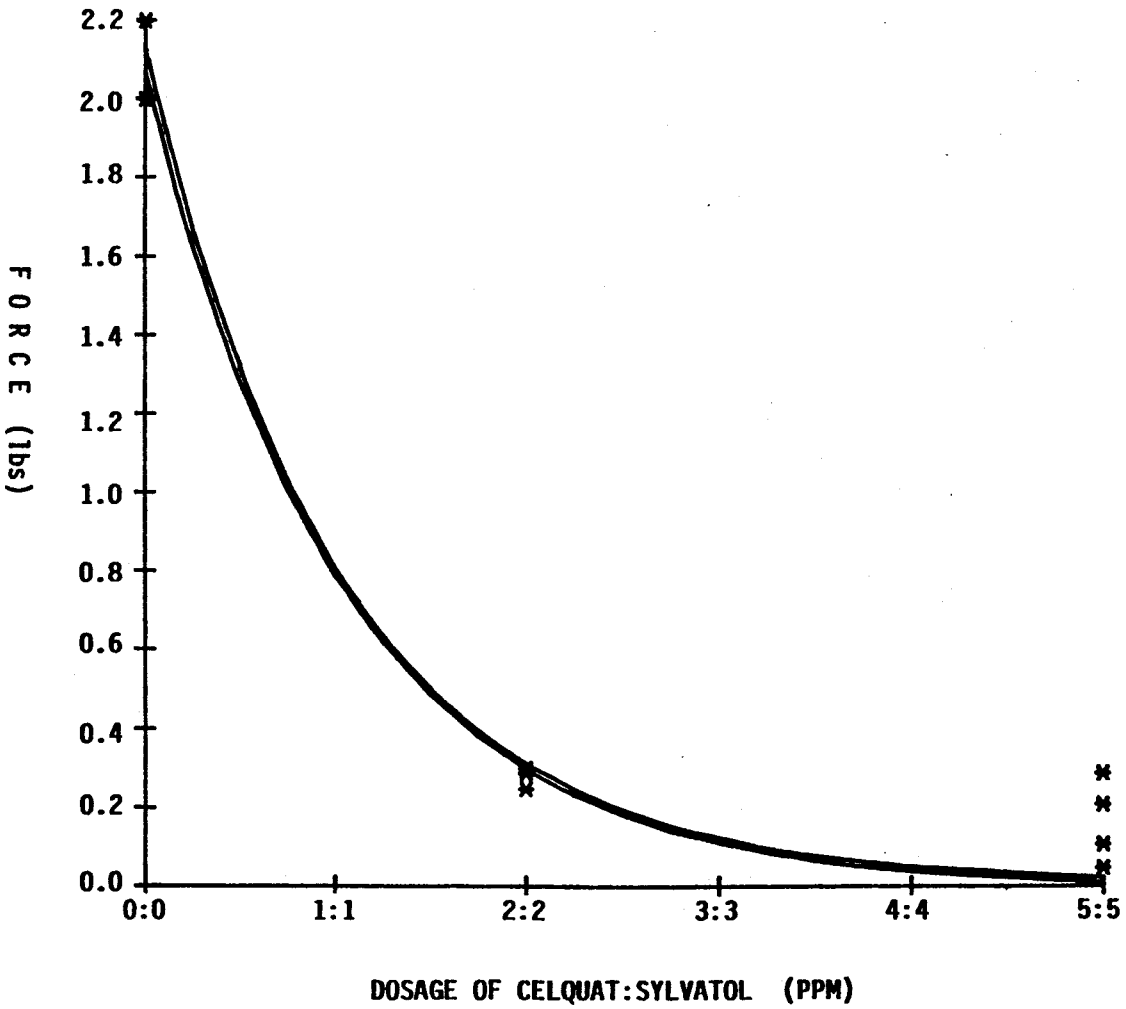

At equal weight ratios of these two compounds, a greater than 95% reduction in tackiness was achieved at dosages of 5 ppm each (FIG. 10).

The treatment of the present invention functions best when the polymer and the oppositely charged surfactant are added at an approximately equal dosage ratio, based on weight. In accordance with the test protocol described above, combinations of polymer plus surfactant were tested where the total dosage remained constant but the ratio of the two additives was varied.

Figure 11:
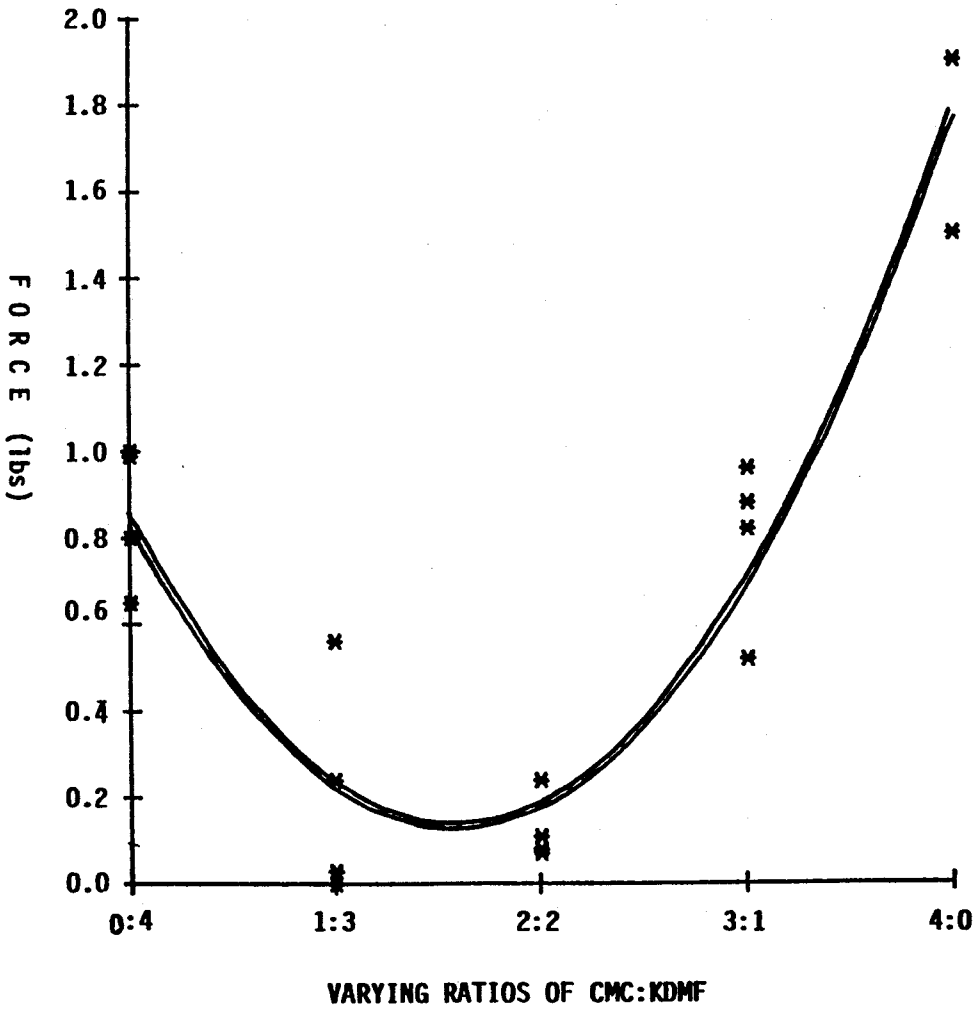
Figure 12:
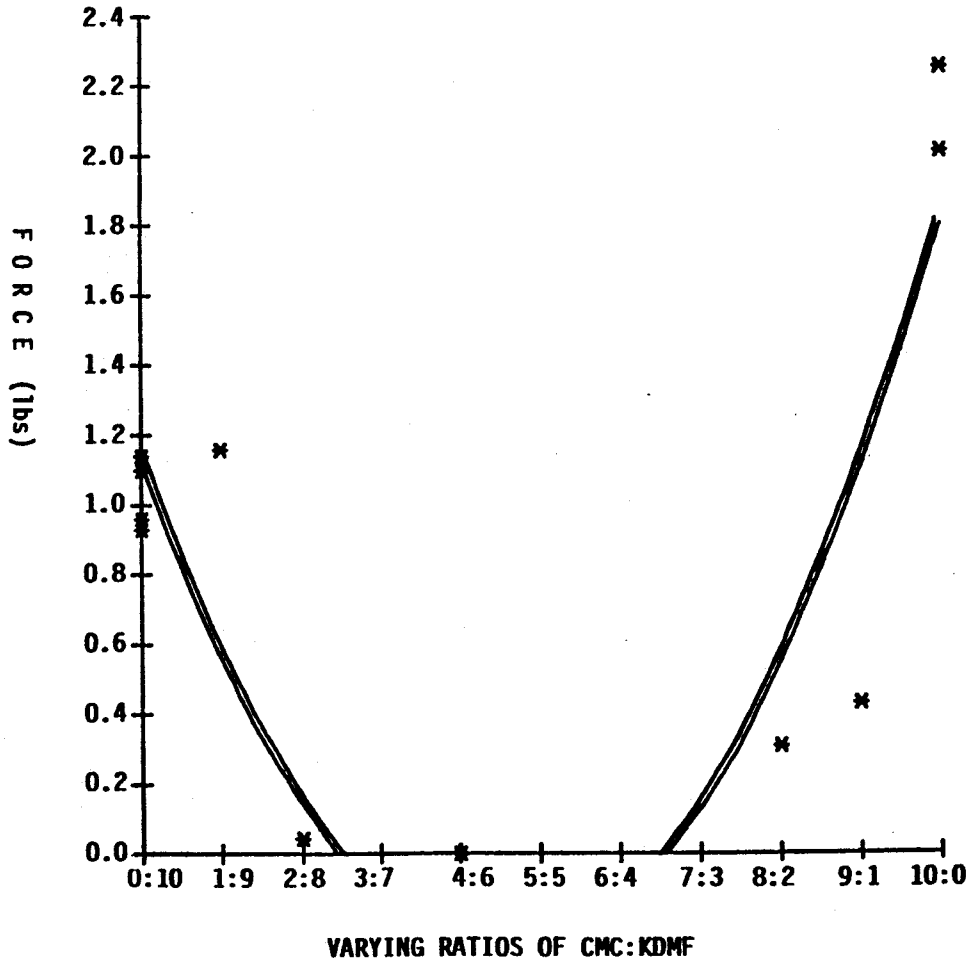
Figure 13:
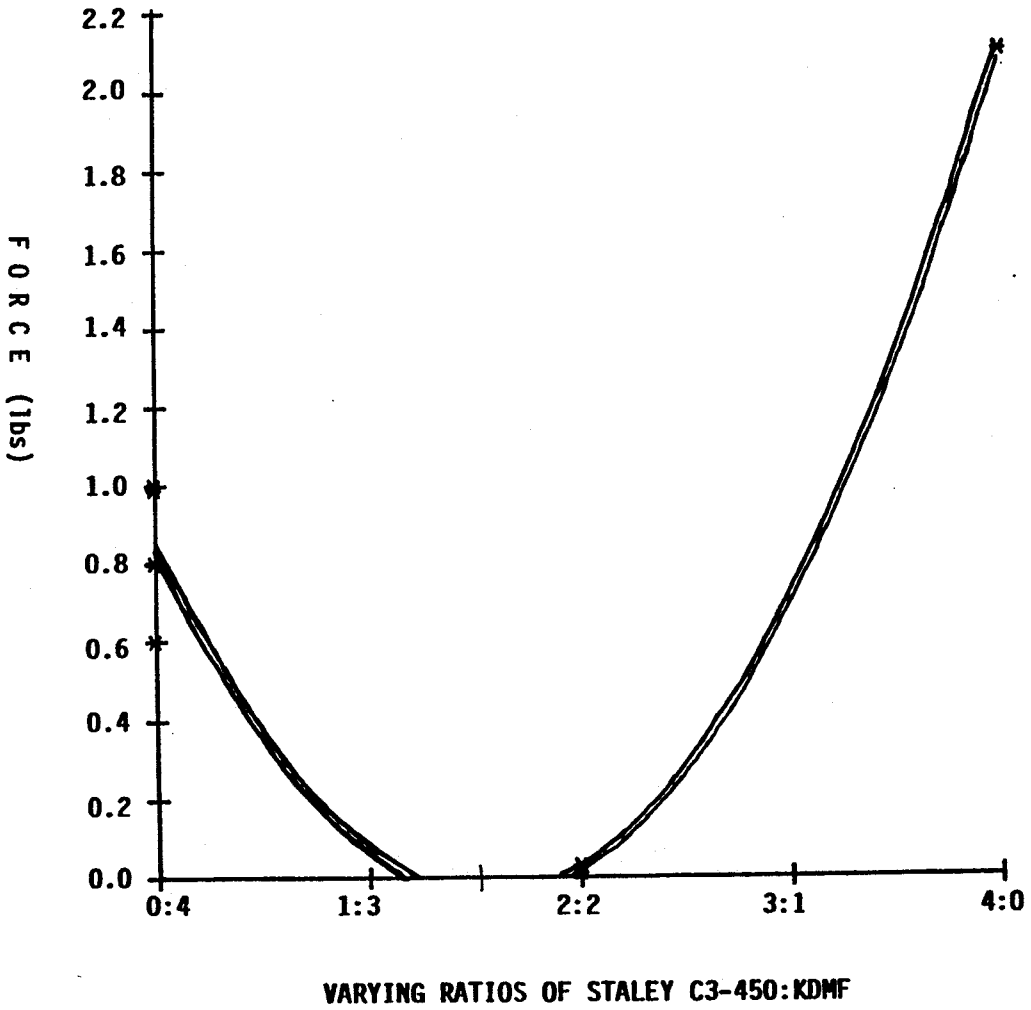
Figure 14:
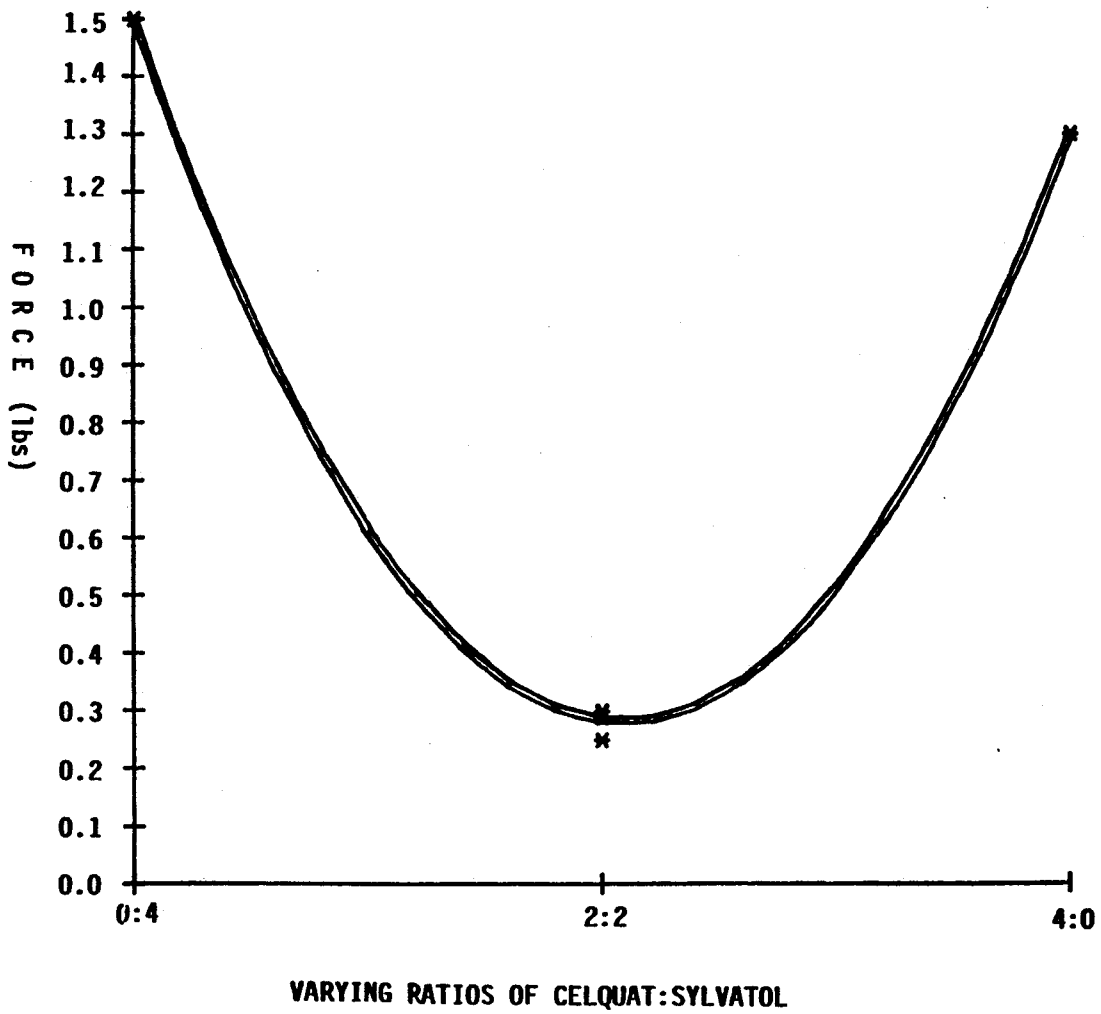

FIG. 11 shows the efficacy of the combination of carboxymethylcellulose (CMC) as the anionic polymer and Genamin KDMF (KDMF) as the cationic surfactant at a total dosage of 4 ppm. FIG. 12 the same two compounds at a total of 10 ppm. FIG. 13 also shows that the efficacy of carboxymethylated starch (Staley 34-450) as the anionic polymer along with KDMF is best at a nearly 1:1 dosage ratio. A further example of this effect is shown in FIG. 14 where equal dosages of the cationic polymer Celquat L-200 were added in combination with the anionic surfactant Sylvatol 40.

In all of the above dosage analyses it is evident that neither compound alone has a significant effect on reducing the tackiness of the sample. It is only when the two compounds are combined at nearly equal weight dosages is the tackiness of the organic contaminant with significantly reduced or completely eliminated.

A treatment for tacky organic-contaminants in pulp and papermaking processes is considered highly effective if a reduction in adhesive force of 90% over the control is achieved. Table I shows the lowest total dosages of equal amounts of various polymer and surfactant combinations required to reach the 90% reduction level. Testing was continued at higher dosages in an effort to achieve a 100% reduction in the tackiness of the organic contaminant.

TABLE 1

Reduction in Tackiness of Organic Contaminants

| Combinations of Equal Ratios of: | Total Dose To Achieve 90% Reduction | Max % Reduction Observed | Max Total Dosage Tested |
|---|---|---|---|
| Genamin KDMF + | | | |
| CMC 12M8 | 3.2 ppm | 100% | 10 ppm |
| CMC 7LT | 4.4 ppm | 95+% | 4.4 ppm |
| LeChem T-75-L | 2.8 ppm | 95+% | 4 ppm |
| Staley C3-450 | 1.2 ppm | 100% | 10 ppm |
| Kelzan D | 1.2 ppm | 100% | 10 ppm |
| Celbond 7 | 1.4 ppm | 100% | 10 ppm |
| Alco 296W | 12.6 ppm | 98% | 20 ppm |
| Sylvatol 40 + | | | |
| Celquat L-200 | 5.0 ppm | 95+% | 10 ppm |

The two ingredients of the present invention may be added to the slurry of the papermaking system either separately or together in a preblended mixture. To demonstrate that similar performance results are-obtained either way, the following analysis was conducted. The oppositely charged compounds used were guar gum (Celbond 7 ) as the anionic polymer and alkyltrimethylamine (Genamin KDMF) as the cationic surfactant. First, 2 ppm of each of the two compounds were added separately and the average adhesion force was measured. Second, the same dosage of the two compounds were mixed together and allowed to stand overnight. Although some precipitation was seen, the mixture remained efficacious. A third sample consisted of the same amount of a preblended mixture to which salt was added to reduce precipitation. The results are shown in Table 2.

TABLE 2

Addition Analysis

| Ingredients | Average Adhesion Force (lbs) |
|---|---|
| Untreated | 2.2 |
| Separately added | .03 |
| Pre-blended | .03 |
| Pre-blended w/salt | .04 |

Analyses were conducted to determine the effect of hardness on the efficacy of the present invention. Since tap water is known to contain hardness, it and deionized water were used as sample substrates and tests were conducted in accordance with the test protocol defined above. The results are shown in Table 3.

TABLE 3

Effects of Hardness on Efficacy

| Treatment | Average Adhesion Force (lbs.) Hard Water | Deionized Water |
|---|---|---|
| Untreated | 2.2 | 1.7 |
| carboxymethylcellulose (1 ppm) + KDMF (3 ppm) | .14 | 1.5 |
| xanthum gum (2 ppm) + KDMF (3 ppm) | .04 | 1.3 |
| Alko 296-W (3 ppm) + KDMF (2 ppm) | .22 | 1.7 |

As can be seen from the above results, the treatment compositions of the present invention are ineffective in deionized water. Some hardness must be present in order for effective detackification to occur.

Further analysis was conducted to determine the effect of system pH on the performance of the present invention. Studies were conducted according to the test protocol described above in water systems having a pH of either 4 or 10. The results shown in Table 4, below, indicate that pH variation has no appreciable effect on treatment efficacy. The present invention may be practical in either acid or alkaline paper-making systems.

TABLE 4

Role of pH on Efficacy

| Treatment | pH 4 | pH 10 |
|---|---|---|
| Untreated | 1.2 | |
| 1 ppm CMC + 3 ppm KDMF | .18 | .03 |
| .5 ppm guar gum + .5 ppm KDMF | .38 | .64 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What we claim is:

1. A method for inhibiting the deposition of organic contaminants in a pulp and papermaking system comprising adding to the system an effective amount for the purpose of a detackifying composition comprising an anionic polymer and cationic surfactant, wherein the anionic polymer is selected from the group consisting of carboxymethyl cellulose, carboxymethylated starch, xantham gum, guar gum and polyacrylic acid, the cationic surfactant is selected from the group consisting of alkyltrimethyl amine and alkyl imidazoline and the anionic surfactant is the sodium soap of tall oil fatty acid wherein the ratio, by weight, of charged polymer to oppositely charged surfactant is approximately 1 to 1.

2. The method of claim 1 wherein the charged polymer and oppositely changed surfactant are added separately to the pulp and papermaking system.

3. The method of claim 1 wherein the charged polymer and oppositely charged surfactant are blended together prior to addition to the pulp and papermaking system.

4. The method of claim 1 wherein the pulp and papermaking system contains hardness.

5. The method of claim 1 wherein the amount of detackifying composition added to the pulp and papermaking system is from about 0.1 to about 100 ppm, by weight.

6. The method of claim 1 wherein the organic contaminants comprise pitch.

7. The method of claim 1 wherein the organic contaminants comprise stickies.

8. The method of claim 1 wherein the organic contaminants comprise both pitch and stickies.

* * * * *